US006378438B1

(12) United States Patent
Lussier et al.

(10) Patent No.: US 6,378,438 B1
(45) Date of Patent: Apr. 30, 2002

(54) SHAPE CHARGE ASSEMBLY SYSTEM

(75) Inventors: Norman Gerald Lussier; Michael Norman Lussier, both of Calgary (CA)

(73) Assignee: Prime Perforating Systems Limited, Calgary (CA)

( * ) Notice: Subject to any disclaimer, the term of this patent is extended or adjusted under 35 U.S.C. 154(b) by 0 days.

(21) Appl. No.: 09/514,549

(22) Filed: Feb. 28, 2000

Related U.S. Application Data

(63) Continuation of application No. 08/760,522, filed on Dec. 5, 1996, now abandoned.

(51) Int. Cl.[7] ..... F42B 1/00
(52) U.S. Cl. ..... 102/307; 102/306; 102/476
(58) Field of Search ..... 102/307, 306, 102/476

(56) References Cited

U.S. PATENT DOCUMENTS 3,336,868 A * 8/1967 Rush et al. ..... 102/307 X
4,875,414 A * 10/1989 Stadler et al. ..... 102/307 X
4,896,609 A * 1/1990 Betts et al. ..... 102/307 X
5,204,493 A * 4/1993 Christmann et al. .... 102/307 X
5,501,154 A * 3/1996 Rodney et al. ..... 102/307 X
5,522,319 A * 6/1996 Haselman, Jr. ..... 102/306
5,814,758 A * 9/1998 Leidel ..... 102/307
5,827,995 A * 10/1998 Graham ..... 102/307

FOREIGN PATENT DOCUMENTS

EP 0252385 * 1/1988 ..... 102/476

OTHER PUBLICATIONS

Vigil et al., U.S.S.I.R. #H 1216, Aug 3, 1993 (Copy in 102/476),*

* cited by examiner

*Primary Examiner*—Peter A. Nelson
(74) *Attorney, Agent, or Firm*—John C. Hunt

(57) ABSTRACT

Shaped charge assembly for use as part of a perforating gun, particularly, channel finder gun. The shaped charge assembly includes a charge is configured to produce a jet which is substantially non-circular in cross section (in relation to the axial direction of travel of the jet) in which the assembly includes a base that is relatively rigid with respect to the liner of the assembly.

39 Claims, 7 Drawing Sheets

SHAPE CHARGE ASSEMBLY SYSTEM

This application is a continuation of U.S. patent application Ser. No. 08/760,522, filed Dec. 5, 1996, now abandoned, the specification of which application is incorporated herein by reference.

FIELD OF THE INVENTION

This invention is in the field of shaped charges for use in perforating gun systems.

BACKGROUND OF THE INVENTION

Installation of an oil or gas well involves fixing a tubular steel casing in cement in an underground bore. Holes are subsequently created in the steel casing and cement in order to gain access to the surrounding formation, i.e., oil or gas deposit. Such holes are generally created through a process known as perforation using a perforating gun. A well may also need to be re-perforated from time to time, for example, if the flow of oil or gas into the well becomes impeded by debris. It is also common practice to re-perforate a depleted well which is to be abandoned. Such wells are often sealed by introduction of cement between the casing and well bore to minimize leakage of remaining oil or gas. Re-perforation is carried out to open existing channels in order to improve infusion of the cement. Such specialized perforating guns are sometimes referred to in the industry as "channel finder guns".

In general, a perforating gun includes an elongate member having several explosive charges spaced along the member. There is a detonation cord running between and connected to the charges. The charges are generally arranged along the length of the gun to explode radially outwardly in different directions into the formation. Such a charge, known as a "shaped charge", includes a case, often conically shaped, which contains explosive material sealed in the case interior by a liner. When detonated, the charge delivers explosive forces to penetrate into the formation.

Efforts continue to be made to improve various aspects of the perforation process. For example, Renfro describes in U.S. Pat. No. 5,509,356 (Apr. 23, 1996), the specification of which is incorporated herein by reference, a shaped charge with an improved liner. The charge includes a housing made of a pulverable material such as a ceramic. The shaped charge includes explosive powder and a binder and the powder is pre-compressed to at least 95% of its total maximum density. The liner is generally hemispherical, but decreases in thickness from the central area to its perimeter, or skirt.

Hasselman describes in U.S. Pat No. 5,522,319 (Jun. 4, 1996), the specification of which is incorporated herein by reference, another effort to provide an improved shaped charge for oil well perforation in which a generally hemispherically shaped liner is thicker at its central region than towards its edge. This apparently improves the coherence, stability and mass distribution of the jet produced such that a tip velocity comparable to that of a conical shaped charge is obtained. The case housing of the charge is not described in detail, but is illustrated to be of uniform thickness and, being of thickness of the same order of the liner, is presumably metal. Hasselman states that the case material and configuration are of little importance to the overall design optimization, although they do have an effect and need to be included in any detailed design.

Willis et al. describe in U.S. Pat No. 5,564,499 (Oct. 15, 1996), the specification of which is incorporated herein by reference, a method and device for slotting well casing and scoring surrounding rock to facilitate hydraulic fractures. The device shown includes linear charges arranged lengthwise in the gun and concentrically about the center axis of the gun. This arrangement is described as creating a linear aperture in the well casing in which the charges are exploded.

Conventional perforating guns, however, have been found not to be entirely satisfactory when used to perforate a well in preparation for introduction of cementitious material to seal the casing to the well bore, i.e., when used as channel finder guns. The degree of perforation by such guns is sometimes insufficient to adequately open channels which can lead to insufficient infusion of the material into areas surrounding the casing. This can lead to an inadequate seal which permits leakage of formation contents, typically water, gas, or oil from between the casing and the formation. The invention disclosed herein has been found to be particularly useful in the context of this situation, although its application is not limited to such.

GENERAL DESCRIPTION OF THE INVENTION

The present invention involves a shaped charge assembly which produces a superior performance when used as part of a perforating gun to be used as a channel finder gun. The improved performance stems from the use of a shaped charge assembly in which the charge is configured to produce a jet which is substantially non-circular in cross section (in relation to the axial direction of travel of the jet) in which the assembly includes a base that is relatively rigid with respect to the liner of the assembly.

According to a preferred embodiment, the shaped charge assembly includes a linear shaped charge.

Thus, in one broad aspect, the invention is a shaped charge assembly having: a relatively rigid base that has a cavity; a relatively flexible liner; and a shaped charge located in the cavity, wherein the charge is in a shape and the liner located such that, upon explosion of the charge, the liner is propelled along an axial direction of thrust in the formation of a jet having a cross sectional shape which is non-circular.

The cavity of the base can have an opening at a top end of the base and preferably at least a portion of the liner is located in the opening of the base and the charge is shaped such that, upon explosion thereof, the jet travels along a major axis through the opening of the base.

Preferably, the shaped charge is a linear charge.

The base can be of milled steel, stamped metal, or cast metal, etc.

The exposed, or outer surface part of the liner can be concave.

The liner (or the portion of the liner in the opening of the base) can be "V"-shaped and inwardly concave with respect to the top end of the base, or the liner can be "W"-shaped and be generally inwardly directed with respect to the top end of the base.

Particularly, interior surfaces of the base can define a longitudinal trough extending between first and second ends of the base, there can be first and second walls extending between the first and second ends, respectively, third and fourth walls extending between the first ends of the first and second walls, and the second ends of the first and second walls, respectively, and the base can include a pair of apertures therethrough for contacting detonator wires with the charge.

In a particular embodiment, illustrated below, the floor of the cavity has a central ridge extending upwardly toward the liner.

In certain embodiments, there are substantially upright interior side walls extending between the first and second ends of the base.

It is possible for the interior floor surface of the base to be generally concave upward.

In particular embodiments, interior surfaces of the base define a longitudinal trough extending between first and second ends of the base and the liner is concave inward with respect to the cavity such that the shaped material within the cavity has a substantially constant transverse cross section between the first and second ends.

There can be metal foil at the respective first and second ends, to seal the charge in the assembly.

Usually, the base and liner are each of metal.

Usually, the base has a floor having a thickness at least twice that of the liner. The base can have a floor having a thickness at least three times the thickness of the liner. The base can have a floor having a thickness at least four times the thickness of the liner. The base can have a floor having a thickness at least five times the thickness of the liner. The base can have a floor having a thickness at least six times the thickness of the liner.

Preferably, the base has walls having interior surfaces which define the cavity and the walls are relatively thick with respect to the thickness of the liner.

The explosive charge material can be compressed directly against inner surfaces of the base. The liner and base can be formed separate from each other.

The charge can be pressed into the cavity by forced abutment with the liner.

The base can be of unitary construction.

In certain embodiments, the base has an interior floor and walls having interior surfaces which extend upwardly of the floor in which the average thickness of the floor and walls is between about 2 and 10 that of the liner; or the average thickness of the floor and walls is between about 3 and 8 that of the liner; or the average thickness of the floor and walls is between about 4 and 6 that of the liner; or the average thickness of the floor and walls is between about 5 times that of the liner.

The thickness of the liner can be between about 1/32" and 1/4". More preferably, the thickness of the liner is about 1/16".

In particular embodiments, the invention is a shaped charge assembly in which the base is of metal and includes a floor and first and second upstanding walls at first and second opposite sides of the base, respectively, to define an upwardly open the cavity and the liner extends between the first and second walls, and the charge is compressed in the cavity such that the shape of the charge is defined by interior surfaces of the floor, walls and liner. Further, there can be first and second means for sealing the charge within the cavity, extending between first ends of the first and second walls, the liner, and the base floor, and between second ends of the first and second walls, the liner and the base floor, respectively. Such means for sealing the charge within the cavity can be a piece of foil.

Usually, interior surfaces of the first and second walls face each other and are symmetrically shaped with respect to a center line of the assembly. The interior floor surface can define an upwardly concave trough which is symmetrical with respect to the center line. In a preferred embodiment, interior surfaces of the floor, first and second walls and liner define the shape of the charge such that the charge has a generally "V"-shaped cross section. The cross section of the charge can be relatively constant and of a defined thickness.

In particular embodiments, the interior surface of the floor has an upwardly protruding ridge which is generally symmetrical with respect to the center line. The liner can be shaped and oriented so as to be parallel to the center line and be concave upward. In certain preferred embodiments, the liner has a generally "V"-shaped cross section. Alternatively, the liner can be generally "W"-shaped in cross section.

Typically, the inner surfaces of the first and second walls are generally parallel to the center line. Additionally, the inner surfaces of the first and second walls can be generally parallel to each other. In a preferred embodiment, the shaped charge is relatively shallow near the center of the cavity and relatively deep near the first and second walls of the base.

In particular embodiments, a shaped charge assembly of the invention includes a base of metal. The base includes a floor and first and second upstanding walls at first and second opposite sides of the base, respectively, to define an upwardly open cavity and the shaped charge is defined within a relatively flexible sheath, secured within the cavity. The sheath can be held within the cavity by frictional forces between abutting interior surfaces of the base and exterior surfaces of the sheath. The shaped charge can be oriented to explode in a direction away from the floor of the base.

Preferably, there is means for sealing exposed ends of the charge against the environment. The means can be foil. Typically, the foil is a thin metal sheet, such as aluminum foil, and includes a pressure sensitive adhesive for adherence to the charge and base surfaces. Again, the shaped charge can be a linear shaped charge. The shaped charge can have a generally "V"-shaped cross section, which is relatively constant from end to end of the charge. The shaped charge can have a generally "W"-shaped cross section which is relatively constant from end to end of the charge.

In particular embodiments, a shaped charge assembly of the invention includes a base that is of metal and includes a floor and first and second upstanding walls at first and second opposite sides of the base, respectively, and third and fourth upstanding side walls at third and fourth opposite ends of the base, respectively, to define an upwardly open cavity and the liner is secured and extends between the first, second, third and fourth walls so as to seal the charge within the cavity. Preferably, the base is of unitary construction, i.e., is formed of a single piece of material such as cast metal, for example.

In such an embodiment, it is possible to have an arrangement in which interior surfaces of the floor, first, second, third, and fourth walls, and the liner define the shape of the charge. The interior surfaces of the first and second walls can be spaced from each other a distance greater than the distance between the interior surfaces of the third and fourth walls. The interior surfaces of the third and fourth walls can slope upwardly and outwardly. The third and fourth walls preferably are symmetrically shaped with respect to a center line of the assembly.

It is possible for interior surfaces of the walls to be generally upright with respect to the interior surface of the floor. In certain illustrated embodiments, there is a ridge extending upwardly of the floor running parallel to a center line of the assembly running between the first and second walls.

The liner can be generally concave inward. The liner can be generally parallel to a center line of the assembly running between the first and second walls. The liner can have a generally "V"-shaped cross section. The liner can have a generally "W"-shaped cross section.

Preferably, the charge is compressed directly against the inner surfaces and the liner and base are formed separate from each other.

The base can include a pair of apertures therethrough for contacting detonator wires with the charge located in the cavity of the base.

In particular embodiments, a shaped charge assembly of the invention has a base that is of metal and includes a floor and first and second upstanding walls at first and second opposite sides of the base, respectively, and third and fourth upstanding side walls at third and fourth opposite ends of the base, respectively, to define an upwardly open cavity and the shaped charge is defined within a relatively flexible sheath, secured within the cavity.

In such embodiments, it is preferred that the sheath is held within the cavity by frictional forces between abutting interior surfaces of the base and exterior surfaces of the sheath. Often, the shaped charge is oriented to explode in a direction away from the floor of the base. The shaped charge can be a linear shaped charge. The shaped charge can have a generally "V"-shaped cross section, and can be of relatively constant thickness from end to end of the charge. The shaped charge can have a generally "W"-shaped cross section which is relatively constant from end to end of the charge.

In a particular embodiment, the invention is a shaped charge assembly for mounting to a charge holder of an underground perforating gun including: a rigid base which defines a cavity open at a top end of the base; charge material received within the cavity; and a liner, relatively flexible with respect to the base, mounted at the top end of the cavity to seal the material within the cavity; and wherein, interior surfaces of the base and the liner together define the shape of the charge material, which shape is such that, upon detonation, a jet with a non-circular cross-section travels along a major axis through the open end of the cavity of the base.

In another particular aspect, the invention is a combination of a shaped charge assembly and a holder therefore, for use in a longitudinal housing of a perforating gun. The holder defines a slot for receipt of the assembly therein to orient the shaped charge assembly within the housing such that, upon explosion of the charge, the axial direction of thrust is in a direction generally orthogonal to a longitudinal axis of the housing.

The holder usually defines a plurality of slots. Often, each respective shaped charge assembly received in a slot is oriented such that, upon explosion of the charge, the jet has a major planar component through a central thrust axis of the jet, which planar component is non-parallel with the longitudinal axis of the housing. In a particular illustrated embodiment, the planar component is generally orthogonal to the longitudinal axis of the housing.

In such a combination in which there is a plurality of shaped charge assemblies, neighboring shaped charge assemblies can be oriented with respect to each other such that their central thrust axes form an angle of between 10° and 90° with each other, or an angle of between about 20° and 70° with each other, or an angle of between about 30° and 60° with each other, or an angle of about 45° with each other. It possible for assemblies to be dimensioned to permit a density of up to about 16 shaped charge assemblies per meter in a holder, or a density of up to about 14 shaped charge assemblies per meter in a holder, or a density of up to about 12 shaped charge assemblies per meter in a holder, or a density of up to about 10 shaped charge assemblies per meter in a holder.

Such a combination can further include a gun housing.

In another aspect, the invention is a method for perforating a casing of a well bore and a surrounding hydrocarbon-bearing formation. The method includes:

locating at least one shaped charge assembly in the bore, the assembly having a relatively rigid base, a shaped charge in a cavity of the base, and a relatively flexible liner; and exploding the charge, wherein the charge is shaped and oriented within the bore, to produce upon explosion thereof, a jet having an axial direction of thrust in a plane generally orthogonal to the bore and wherein the cross sectional shape of the jet is non-circular.

In another aspect, the present invention is a method for perforating a casing of a bore of a well and a surrounding hydrocarbon-bearing formation which includes:

locating at least one shaped charge assembly of the invention in the bore; and exploding the charge.

The shaped charge can include:

a relatively rigid base having a cavity;

a relatively flexible liner; in which there is:

a shaped charge located in the cavity, wherein the charge is in a shape and the liner located such that, upon explosion of the charge, the liner is propelled along an axial direction of thrust, located in a plane generally orthogonal to the bore, in the formation of a jet having a cross sectional shape which is non-circular.

A particular method is one in which the perforating is conducted in preparation for sealing the well.

BRIEF DESCRIPTION OF DRAWINGS

FIG. 9(*b*) is an end view of the charge holder of FIG. 9(*a*), radii thereof indicating the placement of charge assemblies therein;

DESCRIPTION OF PREFERRED EMBODIMENTS

Turning to the drawings, a description of the preferred mode of implementing the invention, as currently understood by the inventors is described below.

Figure 1:
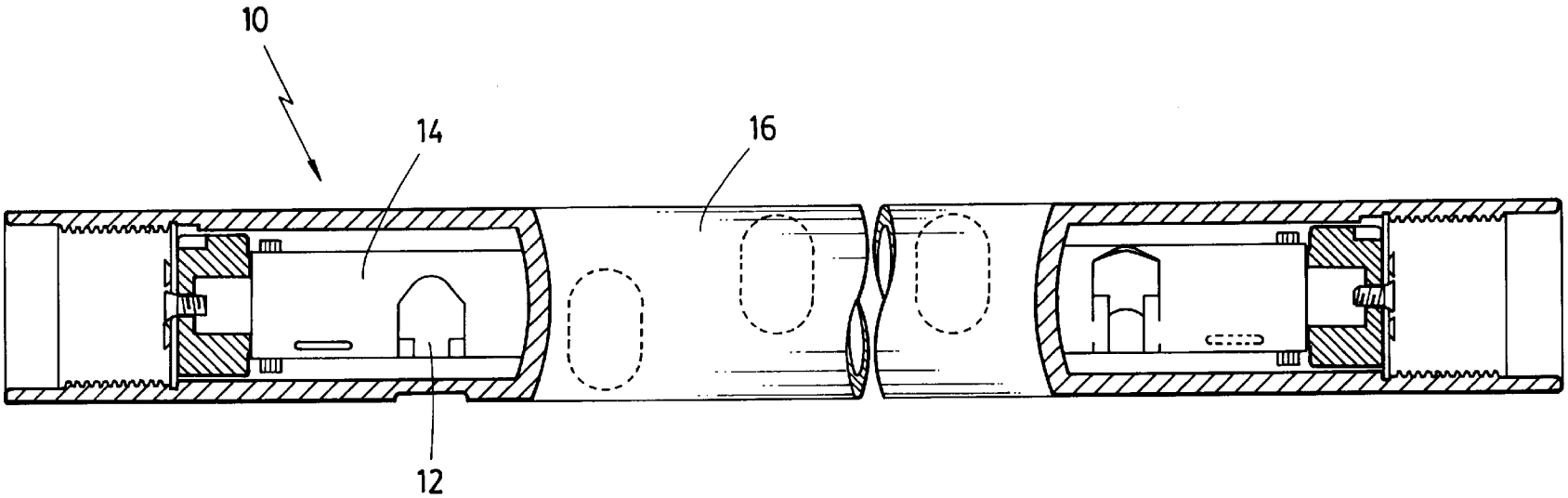
FIG. 1 is an elevational view, in partial section, of a perforating gun, with a plurality of shaped charge assemblies of the present invention mounted to a holder within an elongated gun housing.

Charge assemblies of the illustrated embodiments are for use as part of a perforating gun 10, illustrated in FIG. 1, but may equally well be incorporated into other perforating gun systems, appropriately modified as necessary. Gun 10 includes linear shaped charge assemblies 12 mounted on charge holder 14 which is sealed and secured within gun outer housing 16.

Figure 2:
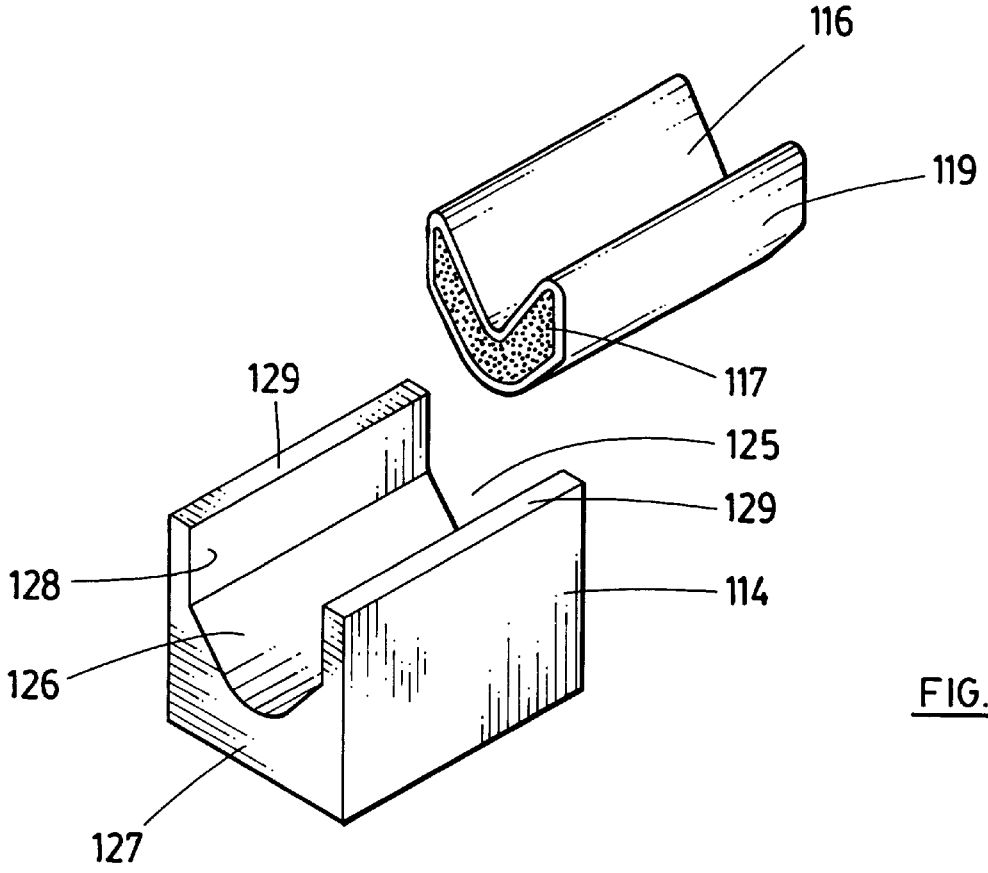
FIG. 2 is an isometric exploded view of a first embodiment shaped charge assembly of the present invention.
Figure 3:
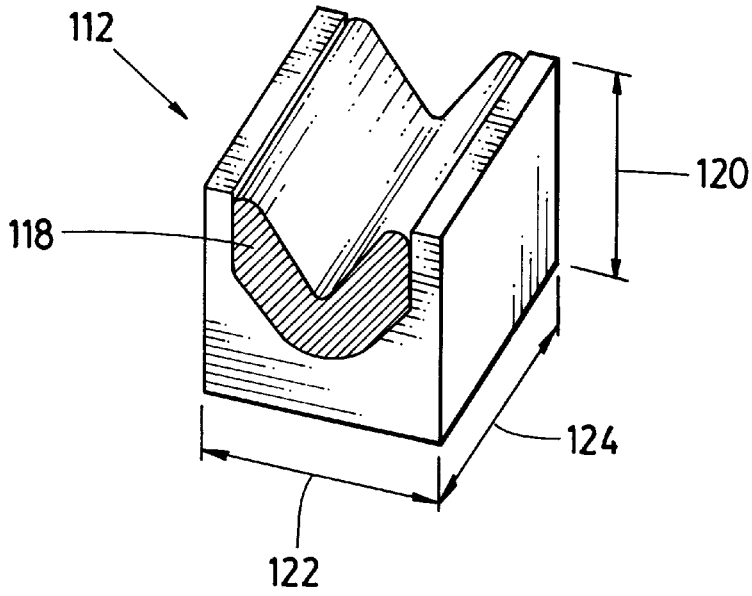
FIG. 3 is an isometric view of a shaped charge assembly of the FIG. 2 embodiment.

A first embodiment charge assembly 112 is illustrated in greater detail in FIGS. 2 and 3. Device 112 includes rigid base 114 having linear shaped charge 116 (with liner 119) received therein. Charge 116 is a linear shaped charge, cut to the same length as the base 112, the charge containing explosive material 117 compressed within metal sheath 119. Such a linear charge is a continuous core of explosive enclosed in a seamless metal sheath, commercially available from Accurate Arms Company, Inc. of McEewen, Tenn. Exposed ends of the charge are capped with adhesive foil 118 (omitted in FIG. 2).

Charge assembly 112 is appropriately dimensioned to be mounted in a holder so as to fit into a selected gun housing. In the illustrated embodiment, the outer housing of the gun has an outer diameter of 86 mm (3⅜") and an inner diameter of 68 mm (2⅝"). Charge holder 14 has an outer diameter of 51 mm (2") and is a tube of thin walled extruded steel, being of substantially constant cross section and substantially constant thickness, having a thickness of about 0.17 cm (0.065"). The overall dimensions of charge assembly base 114 are about 38 mm (1½") 120 (height)×38 mm (1½") 122 (width)×51 mm (2") 124 (length). The product of Accurate Arms Company incorporated as part of assembly 112 bears product number Y230-2000. It is a linear shaped charge having a copper sheath containing core, i.e., explosive material, RDX with a grain load of 2000 per foot. The outerwidth of the linear shaped charge is 1.15" (about 29 mm). Similar linear shaped charge products are commercially available from other sources, for example, Teledyne Ryan Aeronautical of Hollister, Calif.

The base includes cavity 125 defined by interior surface 126 of floor 127 and interior surfaces 128 of side walls 129, which surfaces match the outer contour of the bottom of the sheath of the shaped charge. A friction fit holds the shaped charge within the cavity of the base. That is, the sheath fits snugly against the walls defining the cavity. It is possible that an adhesive could be used to secure the liner charge within the base, alone, or in addition to a friction fit.

Base 114, which houses the linear shaped charge, is of milled steel. As would be appreciated be a person skilled in the art, the base can be of other metals, such as zinc, for instance and it can be manufactured by methods other than milling, such as stamping (cold formed) or by casting. The base can be ceramic.

Figure 4:
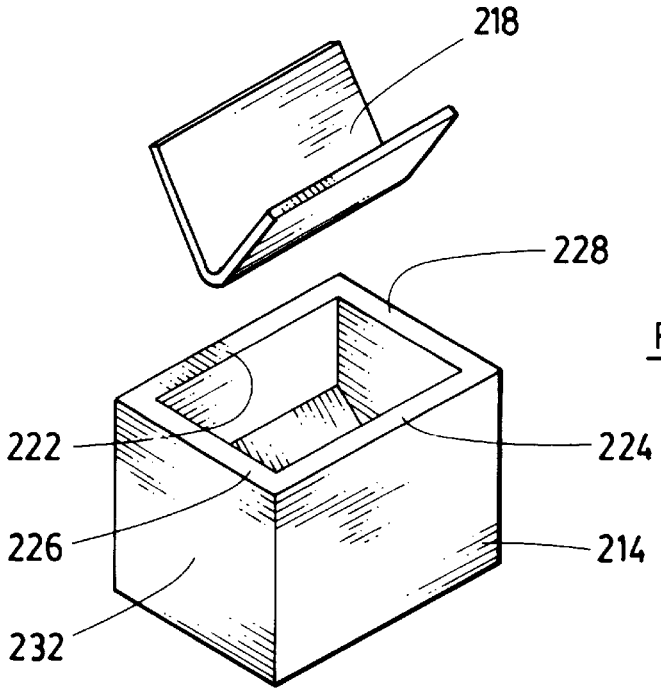
FIG. 4 is an isometric exploded view of a second embodiment shaped charge assembly of the present invention.
Figure 5:
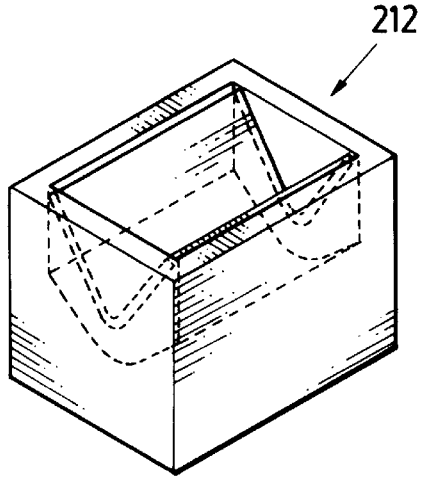
FIG. 5 is an isometric view of the FIG. 4 embodiment, fully assembled.
Figure 6:
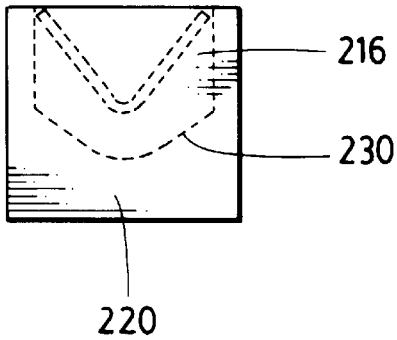
FIG. 6 is an end view of the FIG. 4 embodiment shaped charge assembly.

A second embodiment charge assembly 212 is illustrated in FIGS. 4 to 6. In this embodiment, the charge assembly includes base 214, explosive material 216, and liner 218. Base 214 is formed of one piece, i.e., is of unitary construction, the illustrated housing being milled, pressed or stamped, or cast, as with base 114. Again the base metal can be steel or zinc, etc. Base 214 includes a bottom floor 220 with four upwardly extending side walls 222, 224, 226, 228. The interior surface 230 of the floor of the housing base is shaped to be generally congruent with the corresponding interior portion of sheath 119 of the first embodiment.

Figure 7:
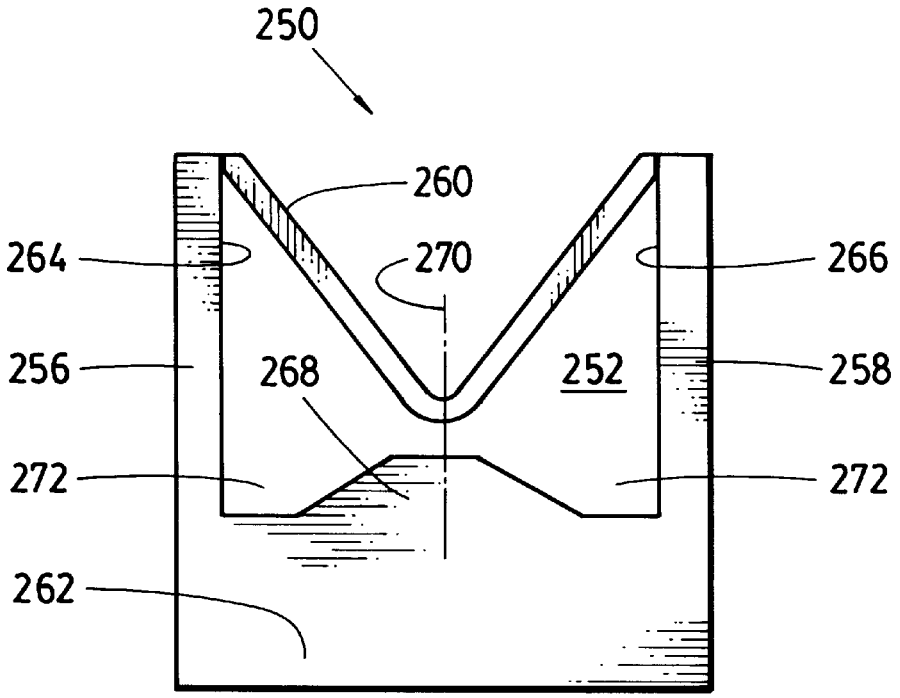
FIG. 7 is an end view representation of the present invention, illustrating the cross sectional profile of a shaped charge a of a third embodiment.

A third embodiment shape charged device 250 is illustrated in FIG. 7, in which the cross sectional shape of the shaped charge 252 is shown. As with other embodiments, base 254 of the assembly might or might not have end walls connecting side walls 256, 258. Interior surfaces of liner 260, the side walls and floor 262 of the base define the shape of the charge, which is compressed within the cavity. The cross sectional width of the cavity defined between the upright parallel inner surfaces 264, 266 of the base is about 30.7 cm (1.2"). The floor of the base has an upraised ridge 268 running between lengthwise ends of the base. The liner has a cross sectional "V"-shape. The depth of the charge increases from line 270 running through the center of the cavity to the peripheral area 272 of the cavity.

Figure 8:
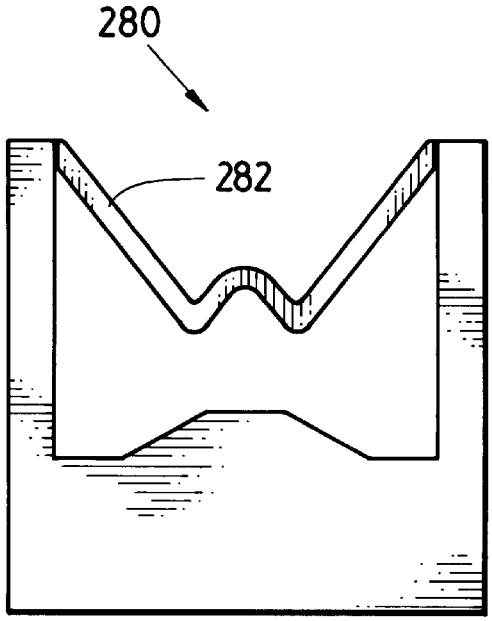
FIG. 8 is an end view representation of the present invention, illustrating the cross sectional profile of a shaped charge a of a fourth embodiment.

A fourth embodiment shaped charge assembly 280 is illustrated in FIG. 8. This is similar to the third embodiment assembly, but the cross section of liner 282 is "W"-shaped.

Located within base 214 (or 254) is compacted or compressed explosive material 216. The material is compressed during installation of the liner, in the case of the second embodiment, liner 218. A liner of the present invention is of any metal from which conventional sheaths of linear shaped charges are manufactured: steel, copper, zinc, lead and combinations or alloys of these metals, particularly copper and zinc, or of a suitable powdered metal. A yellow brass liner might be found to be particularly suitable. The liner is installed as part of the assembly by an operation similar to that used in the manufacture of conical charges. The explosive powder is added to the cavity and the base tapped, if necessary, to level the powder. The powder can be preshaped by insertion of an appropriately shaped die into the cavity. A preshaped liner, held in place, for example by vacuum by the punch die, is then pressed into place and any stray powder cleaned away. The explosive material is compressed during this operation to roughly the same degree as it would be within the liner of the linear shaped charge of the first embodiment. Explosive material is compressed, as understood by a person skilled in the art, to obtain a desired explosive density of the charge. As illustrated for the second embodiment, interior surfaces of floor 230, and walls 222, 224, together define a "V"-shaped cavity into which the explosive material is received. Surfaces of walls 222, 224 face each other to define a trough running parallel to an axis of the housing. Opposing end walls 226, 228 join first and second ends of walls 222, 224, respectively. Generally, speaking, the arrangement is such that the explosive material is sealed within the charge assembly.

In alternative embodiments, a base similar to that of base 214 (or base 254), for example, is manufactured without end walls 222, 224. In this case the base is located between two walls of a manufacturing apparatus which hold the explosive powder in place during manufacture of the charge assembly. Once the charge and liner are in place, the walls are moved away and metal foil put in place in analogy to foil 118 shown for the first embodiment charge assembly. In the absence of end walls, it is possible to include more explosive charge in a shaped charge assembly, all else being equal.

It may be possible to vary the shape of the explosive material to obtain more optimum explosive impact than that obtained with the shapes described herein. It is certainly known, however, that the chevron configuration shape disclosed can be varied somewhat with retention of satisfactory performance. It is intended that the use of the term "V"-shaped or having a "V"-shaped cross section not be limited to the precise shapes disclosed herein. A satisfactory result can be obtained using a "V"-shape based on a parabola or an ellipse.

Other transverse cross sectional shapes are suitable. Linear "W"-shaped charges are commercially available. A base comparable to base 114 can thus be manufactured with a suitably shaped floor and inner side walls to receive such a charge. Alternatively, a base comparable to that of base 214 can thus be manufactured with a "W"-shaped explosive-receiving cavity and suitable "W"-shaped liner.

Figure 12:
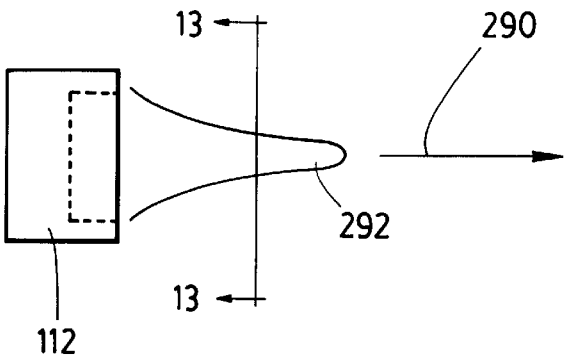
FIG. 12 is a representational view of a shaped charge assembly, as viewed along the longitudinal axis of a holder in which it is mounted showing the general shape of a jet which would be formed upon explosion of the charge.
Figure 13:
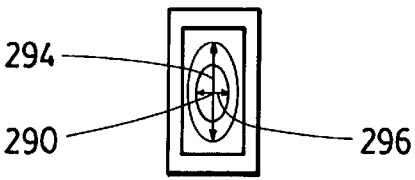
FIG. 13 is a representational view of the jet of FIG. 12 taken along line 13—13 of FIG. 12.

It is not strictly necessary for the shaped charge to be linear. In the case of the second embodiment type of shaped charge device, for example, the interior surfaces of the floor of the base cavity can be slightly curved or arched, i.e., it is not required to be strictly linear running from end-to-end. It is important that the shaped charge have a longitudinal axis (when viewed from the top, i.e., from the side from which the liner is visible) in order that a jet having a non-circular cross section in relation to the major axis 290 of thrust of the jet 292. See FIGS. 12 and 13. A charge is shaped such that the explosive material produces forces having a longitudinal component (when viewed along the axis of the principle direction of the movement of the jet) when the charge is detonated. If one is to look at vectorial forces emanating radially from a central thrust axis of the explosion, there is a vector 294 in a first direction that is different in length from a vector 296 in a second direction perpendicular to the first direction. This is in contrast to conical or hemispherical shaped charges in which the cross section of forces in an imaginary plane perpendicular to the major thrust of the explosion (the major thrust being along a radial line perpendicular to the longitudinal axis of the charge holder, in the FIG. 1 embodiment, for example) are substantially equal, i.e., together define a circle.

The explosive material of the disclosed shaped charge assemblies is RDX, but any suitable explosive can be used, for example, CH-6, HMX, PETN, HNS, PYX, etc. "Shaped charge" is used herein to describe suitable explosive material compressed so as to have a particular shape.

Figure 9B:
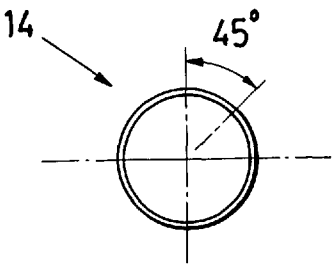
FIG. 9(*a*) is a side elevation of a charge holder of the present invention having slots for receipt of preferred embodiment shaped charge assemblies.
Figure 9A:
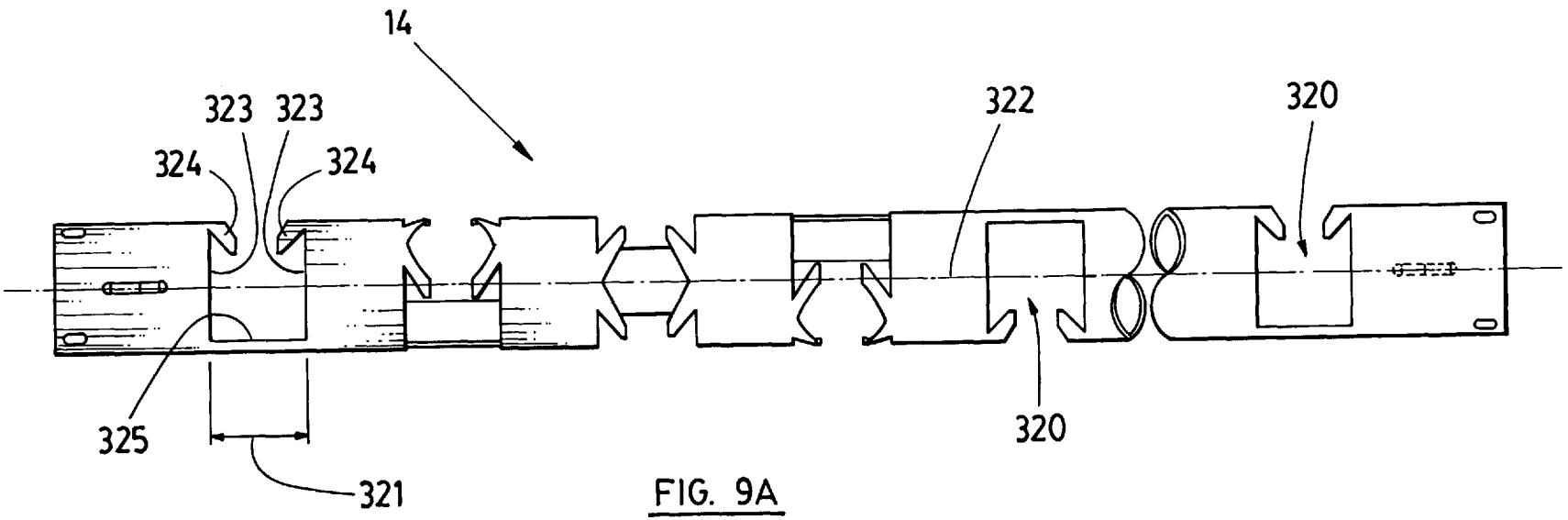

Holder 14 of the illustrated embodiments is illustrated more fully in FIGS. 9*a* and 9*b*. The illustrated holder has a thickness of about 0.17 cm (0.065"). Other thicknesses of metal could possibly be used, say in the range from about 0.010" to about 0.25". The illustrated holder has been used in the field in conjunction with the first embodiment shaped charge assembly described above. The holder is manufactured by laser cutting an extruded steel tube to obtain the illustrated configuration.

Figure 11:
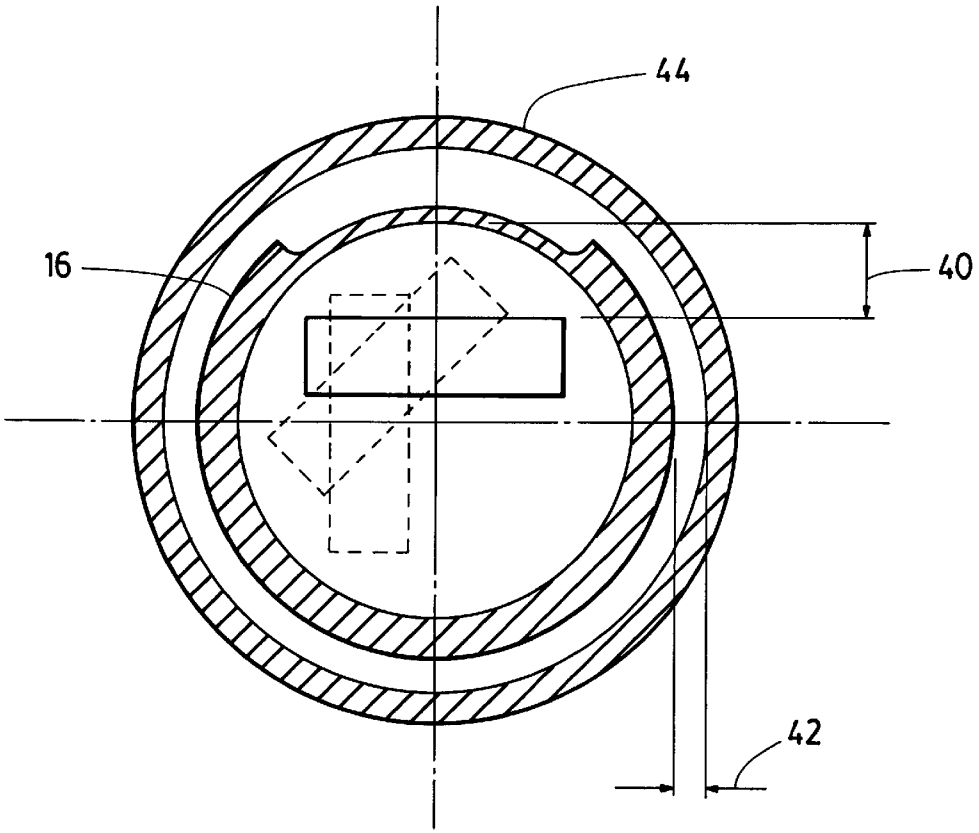
FIG. 11 is a cross sectional view of a gun outer housing within a well hole casing.

The holder defines a slot 320 for receipt of a linear shaped charge assembly. The height 321 of each slot (corresponding to the width of the shaped charge assembly as described above) is 38 mm (1½"). The slots are spaced longitudinally along the length of the holder about 76.2 mm (3") center-to-center from each other. The slots serve to orient the shaped charges in the holder such that neighboring shaped charges are phased at 45° with respect to each other, as illustrated in FIG. 11. The slots of holder 14 thus lie on an imaginary spiral with a complete turn around the circumference of the holder being obtained with every ninth slot. Installed shaped charges spaced from each other by 61 mm (2.4") are thus oriented in the same radial direction. The number of charge assemblies that can be mounted onto a holder for a given length of the holder, usually stated as "shots per meter", is obviously limited by, among other things, the width of the shaped charge assemblies being installed on a holder. For the present invention, it is possible to have up to fourteen, or more, shots per meter.

For installation of a shaped charge assembly within slot 320, the assembly is inserted so that respective outer side walls 130, 132 of the base of the charge assembly abut respective slot defining edges 323, 325 of the charge holder. Once the charge assembly is located centrally with respect to the center line 322 of the holder, tabs 324 are bent radially inwardly to abut upper (radially outward) surfaces of the shaped charge assembly to securely mount the assembly to the holder. A detonation cord is located in the holder to run from end to end of the tube. In the case of the FIG. 1 embodiment charge assembly 112 (or other charge assembly in having foil which seals in charge material), the detonation cord is secured to foil 118 by means of a clip. In the case of shaped charge assembly 212, end wall 226 has a slot 232 with a clip for receipt of the detonation cord. The clip is inserted through the slot to connect the detonation cord and the explosive material for detonation thereof. As an alternative arrangement, the slot for receiving the clip might be located at a central location of the floor of the charge assembly base. Once all of the charge assemblies and detonation cord are mounted, the holder-charge assembly is installed in gun housing 16.

Figures 10A, 10B, 10C:
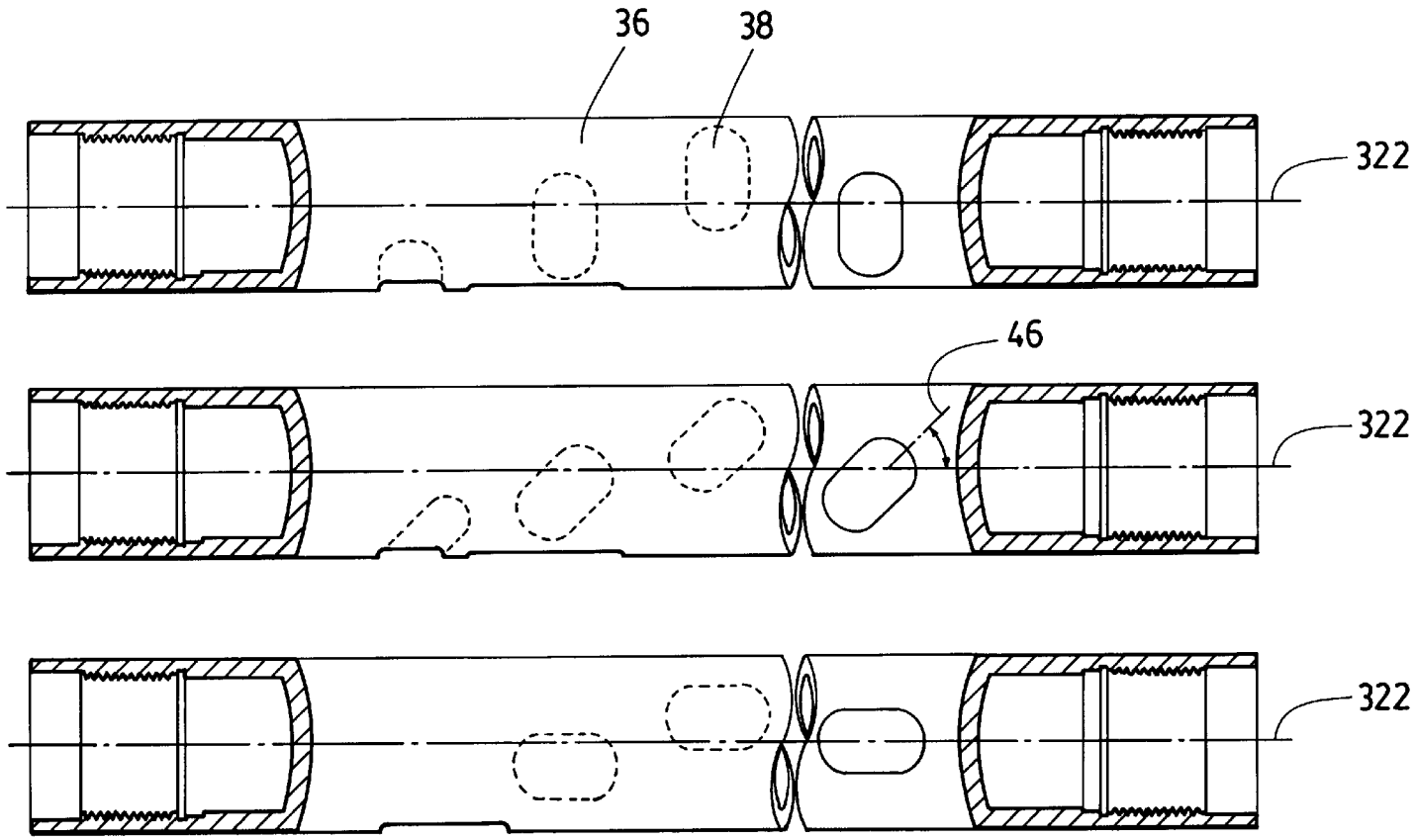
FIGS. 10(*a*), 10(*b*) and 10(*c*) each show an outer housing of a perforating gun of the present invention, having thinned areas corresponding to the shaped charge assemblies of the preferred embodiments, in which longitudinal axes of the shaped charges are angled at 90°, 45° and 0°, respectively, with respect to the lengthwise (i.e., longitudinal) axis of a charge holder in which the assemblies are mounted.

Gun housing 16 is illustrated in FIGS. 1, 10(*a*) and 11. Each lengthwise end of the holder is secured to the housing in a conventional manner. The detonation cord (not illustrated) extends out of the upper end of the housing to be connected to a detonator (not illustrated), this being a conventional arrangement. The interior of the housing is sealed against ingress of liquid, again in a conventional manner, so that it can be installed in a well for use without exposure of the explosive material to liquid which might diminish its explosive capacity.

Outer surface 36 of gun housing 16 has scalloped areas 38 which are thinned areas bored out of the housing. These areas of reduced thickness are spaced from each other along a spiral corresponding to that of the installed shaped charges. Each thinned area is suitably sized and shaped to accommodate the jet which emanates from the charge to which it is immediately adjacent when the gun is set off. This enhances the explosive capacity of the gun by reducing the amount of force consumed in breaking through the gun housing. Thinned areas in a gun housing are known to those skilled in the art.

Turning to FIG. 11, location of charge assemblies (the charge holder has been omitted for clarity) in relation to the gun housing and well casing 44 is illustrated. Casing 44 has an outer diameter of 114 mm (4½") and a thickness of 7.37 mm (0.29"). The outer diameter of the gun housing 16 is 86 mm (3⅜") while the thickness of the scalloped portions of the gun housing is 15.2 mm (0.60"). The stand off 40 (the distance between the forward edge of a charge assembly and the inner surface of the gun housing) is 21 mm (0.815") and the clearance 42 is 6.9 mm (0.273"). The standoff distance is important since sufficient distance must be provided to permit adequate jet formation to obtain the desired penetration, while the distance should not be too great that the jet expands too greatly (in a radial direction to the axial direction of thrust of the jet), which can result in an oversized hole. The distances indicated have been found to produce satisfactory results.

In the illustrated embodiment, each linear shaped charge assembly, when viewed from the liner side (when viewed from the top of the charge assembly as oriented in FIG. 4) is non-circular. Various shapes of linear shaped charges are described in, for example, on pages 737–8 of *High Velocity Impact Dynamics* (Ed. Jonas A. Zukas, John Wiley & Sons, Inc., New York 1990), the contents of which reference are incorporated herein by reference.

Shaped charge assemblies similar to assembly 112, but having dimensions suitable for use in an outer gun housing of diameter 114 mm (4½") or 146 mm (5¾") are also possible. In the case of a 9.5 mm (⅜") thick gun housing having an outer diameter 114 mm (4½"), the base of the charge assembly is 66.7 mm (2⅝") in length with the height and width being the same as those shown for charge assembly 112. Such a gun is suitable for use in a well casing having an outer diameter of 140 mm (5½") and thickness of 70 mm (0.275") with a stand off distance of 19 mm (¾") and clearance of 5.7 mm (0.225"). In the case of a 8.9 mm (0.375") thick gun housing having an outer diameter of 146 mm (5¾"), the base of the charge assembly is 76 mm (3.0") in length, again with the height and width being the same as those of charge assembly 112. Such a gun is suitable for use in a well casing having an outer diameter of 178 mm (7.0") and thickness of 9.2 mm (0.362") with a stand off of 19 mm (¾") and clearance of 6.7 mm (0.263"). Similar dimensional arrangements are obtainable with a second embodiment type of charge assembly in which charge material is pressed directly into base 214.

Perforating guns incorporating shaped charge assemblies of the first embodiment having a 2" diameter charge holder have been used in the field. Although rigorous studies have not been carried out, it appears that the pattern of "ribbon"-shaped jets generated by the slot charges more reliably hit channels, i.e., gain access to channels, than the pattern generated by conical shaped charges in a comparable perforating gun, as indicated by the amount cement pumpable following perforation.

In the embodiments disclosed, the liner has a thickness of about 0.8 mm (1/32"). A liner can have a smaller or greater thickness, possibly up to about 6 mm (¼") in thickness. The thickness must be sufficient to provide enough material to form the head of a jet upon explosion of the charge material, as understood by those skilled in the art.

Although phasing of 45° has been illustrated in FIG. 9, it will be understood that phasing of other angles, such as 15°, 30°, 60°, 90°, etc. are within the scope of this invention.

Turning to FIGS. 10(*a*) to 10(*c*), angling of slot-shaped charge assemblies is illustrated. Scalloped areas of the illustrated gun housings correspond to underlying charge assemblies, not directly illustrated. Thus in FIG. 10(*c*), longitudinal axis 46 of a slot charge assembly is parallel to the center axis 322 of the holder. Put another way, the longitudinal axis of the charge assembly is perpendicular to a cross-sectional plane of the gun. FIG. 10(*b*) shows an arrangement in which the longitudinal axes of slot-shaped charge assemblies each form an angle of 45° with the center line of the charge holder. Other angles of incidence between the center axis and longitudinal axes of shaped charges are within the scope of this invention.

In all of the illustrated embodiments, charges are oriented such that upon detonation, each jet travels in a direction which is generally radially outwardly along a radius of the center line of the gun and parallel to a plane generally perpendicular to the center axis of the gun. This is the generally preferred arrangement, as it maximizes the jet forces impinging upon the gun housing and well casing, the jet traveling in a direction which is more or less orthogonal to these two metal surfaces through which it must travel to penetrate into a formation. Although there is a limit to the amount of deviation than can be made from this orientation, other orientations are within the scope of this invention. It is most likely that maintaining a jet direction along a radius of the center line of the gun will remain preferable, with a greater variation in the deviation of jet thrust out of the cross-sectional plane of the gun being more likely.

Advantages over obtainable through use of a perforating gun of the present invention over conventional guns may extend beyond use as a channel finder. Particularly, a gun of the present invention may find use in gravel pack perforating of a well, or in perforation of a horizontal section of a well.

Particular embodiments of the invention having been described, the scope of the invention for which protection is sought is defined by the following claims.

What is claimed is:

1. A shaped charge assembly comprising:

a rigid metal base having a cavity;

a liner; and a shaped charge located in the cavity, wherein the charge is in a shape and the liner located such that, upon explosion of the charge, the liner is propelled along an axial direction of thrust in the formation of a jet having a cross sectional shape which is non-circular.

2. The shaped charge assembly of claim 1 wherein the base is of milled steel or, wherein the base is of stamped metal, or wherein the base is of cast metal.

3. The shaped charge assembly of claim 1 wherein: the liner has an outer concave surface; the base has interior surfaces which define a longitudinal trough extending between first and second ends of the bases; and a floor of the cavity has a central ridge extending upwardly toward the liner.

4. The shaped charge assembly of claim 3 wherein said interior surfaces of the base define said longitudinal trough extending between said first and second ends of the base and the liner is concave inward with respect to the cavity such that the shaped material within the cavity has a substantially constant transverse cross section between the first and second ends.

5. The shaped charge assembly of claim 1 wherein base has walls having interior surfaces which define the cavity and the walls are relatively thick with respect to the thickness of the liner, and optionally:

wherein the charge is compressed directly against said inner surfaces and the liner and base are formed separate from each other; and optionally:

wherein the charge is pressed into the cavity by forced abutment with the liner.

6. The shaped charge assembly of claim 4 wherein the base has an interior floor and walls having interior surfaces which extend upwardly of the floor, wherein the average thickness of the base is between about 2 and 10 that of the liner.

7. The shaped charge assembly of claim 1 wherein the base is of metal and includes a floor and first and second upstanding walls at first and second opposite sides of the base, respectively, to define an upwardly open said cavity and the liner extends between the first and second walls, and the charge is compressed in the cavity such that the shape of the charge is defined by interior surfaces of the floor, walls and liner, and optionally:

further comprising first and second means for sealing the charge within the cavity, extending between first ends of the first and second walls, the liner, and the base floor, and between second ends of the first and second walls, the liner and the base floor, respectively, and optionally wherein:

each means for sealing the charge within the cavity comprises a piece of foil.

8. The shaped charge assembly of claim 6 wherein the interior surface of the floor has an upwardly protruding ridge which is generally symmetrical with respect to said center line, and optionally:

wherein the liner is parallel to the center line and is concave upward, and preferably:

wherein the liner has a generally "V"-shaped cross section, or:

wherein the liner is generally "W"-shaped in cross section.

9. The shaped charge assembly of claim 6 wherein the inner surfaces of the first and second walls are generally parallel to said center line, and optionally:

wherein the inner surfaces of the first and second walls are generally parallel to each other.

10. The shaped charge assembly of claim 6 wherein the shaped charge is relatively shallow near the center of the cavity and relatively deep near the first and second walls of the base.

11. The shaped charge assembly of claim 1 wherein the base is of metal and includes a floor and first and second upstanding walls at first and second opposite sides of the base, respectively, to define an upwardly open cavity and the shaped charge is defined within a relatively flexible sheath, secured within the cavity, and optionally:

wherein the sheath is held within the cavity by frictional forces between abutting interior surfaces of the base and exterior surfaces of the sheath, and/or:

wherein the shaped charge is oriented to explode in a direction away from the floor of the base, and/or:

further comprising means for sealing exposed ends of the charge against the environment, preferably, wherein said means for sealing each end of the charge comprises a piece of foil.

12. The shaped charge assembly of claim 11 wherein said shaped charge is a linear shaped charge, and/or wherein the shaped charge has a generally "V"-shaped cross section, which is relatively constant from end to end of the charge, or:

wherein the shaped charge has a generally "W"-shaped cross section which is relatively constant from end to end of the charge.

13. The shaped charge assembly of claim 1 wherein the base is of metal and includes a floor and first and second upstanding walls at first and second opposite sides of the base, respectively, and third and fourth upstanding side walls at third and fourth opposite ends of the base, respectively, to define an upwardly open said cavity and the liner is secured and extends between the first, second, third and fourth walls so as to seal the charge within the cavity, optionally:

wherein the base is of unitary construction, and/or:

wherein interior surfaces of the floor, first, second, third, and fourth walls, and the liner define the shape of the charge, preferably:

wherein the interior surfaces of the first and second walls are spaced from each other a distance greater than the distance between the interior surfaces of the third and fourth walls, and/or:

wherein the interior surfaces of the third and fourth walls slope upwardly and outwardly, and/or:

wherein the third and fourth walls are symmetrically shaped with respect to a center line of the assembly, and/or:

wherein the interior surfaces of the walls are generally upright with respect to the interior surface of the floor, and/or:

wherein there is a ridge extending upwardly of the floor running parallel to a center line of the assembly running between the first and second walls, and/or:

wherein the liner is generally concave inward, and/or:

wherein the liner is generally parallel to a center line of the assembly running between the first and second walls, preferably:

wherein the liner has a generally "V"-shaped cross section, or:

wherein the liner has a generally "W"-shaped cross section.

14. The shaped charge assembly of claim 13 wherein the charge is compressed directly against said inner surfaces and the liner and base are formed separate from each other, and optionally:

wherein the base includes a pair of apertures therethrough for contacting detonator wires with the charge.

15. The shaped charge assembly of claim 1 wherein the base is of metal and includes a floor and first and second upstanding walls at first and second opposite sides of the base, respectively, and third and fourth upstanding side walls at third and fourth opposite ends of the base, respectively, to define an upwardly open said cavity and the shaped charge is defined within a relatively flexible sheath, secured within the cavity.

16. The shaped charge assembly of claim 15 wherein the sheath is held within the cavity by frictional forces between abutting interior surfaces of the base and exterior surfaces of the sheath, and/or:

wherein the shaped charge is oriented to explode in a direction away from the floor of the base, and/or:

wherein said shaped charge is a linear shaped charge.

17. The shaped charge assembly of claim 15 wherein the shaped charge has a generally "V"-shaped cross section, and is of relatively constant thickness from end to end of the charge, or:

wherein the shaped charge has a generally "W"-shaped cross section which is relatively constant from end to end of the charge.

18. A shaped charge assembly for mounting to a charge holder of an underground perforating gun comprising:

a rigid base which defines a cavity open at a top end of the base;

charge material received within the cavity; and a liner, relatively flexible with respect to the base, mounted at the top end of the cavity to seal the material within the cavity; and wherein, interior surfaces of the base and the liner together define the shape of the charge material, which shape is such that, upon detonation, a jet with a non-circular cross-section travels along a major axis through the open end of the cavity of the base.

19. In combination, at least one shaped charge assembly of claim 1 and a holder therefor, for use in a longitudinal housing of a perforating gun, wherein the holder defines a slot for receipt of the assembly therein to orient the shaped charge assembly within the housing such that, upon explosion of the charge, the axial direction of thrust is in a direction generally orthogonal to a longitudinal axis of the housing.

20. The combination of claim 19, wherein each assembly is dimensioned to permit a density of up to about 16 shaped charge assemblies per meter in a said holder.

21. The combination of claim 19, further comprising a said housing.

22. A method for perforating a casing of a well bore and a surrounding hydrocarbon-bearing formation, comprising:

locating at least one shaped charge assembly in the bore, the assembly having a relatively rigid base, a shaped charge in a cavity of the base, and a relatively flexible liner; and exploding the charge, wherein the charge is shaped and oriented within the bore, to produce upon explosion thereof, a jet having an axial direction of thrust in a plane generally orthogonal to the bore and wherein the cross sectional shape of the jet is non-circular.

23. A method for perforating a casing of a bore of a well and a surrounding hydrocarbon-bearing formation, comprising:

locating at least one shaped charge assembly in the bore; and exploding the charge, wherein, the shaped charge assembly comprises:

a relatively rigid base having a cavity;

a relatively flexible liner; and a shaped charge located in the cavity, wherein the charge is in a shape and the liner located such that, upon explosion of the charge, the liner is propelled along an axial direction of thrust, located in a plane generally orthogonal to the bore, in the formation of a jet having a cross sectional shape which is non-circular.

24. The shaped charge assembly of claim 6 wherein the average thickness of the base is between about 3 and 8 that of the liner.

25. The shaped charge assembly of claim 24 wherein the average thickness of the based is between about 4 and 6 that of the liner.

26. The shaped charge assembly of claim 25 wherein the base includes first and second walls having interior surfaces which face each other and are symmetrically shaped with respect to a center line of the assembly.

27. The shaped charge assembly of claim 26 wherein said protruding ridge is generally symmetrical with respect to the center line.

28. The shaped charge assembly of claim 27 wherein the shaped charge is relatively shallow near the center of the cavity and relatively deep near the first and second walls of the base.

29. The shaped charge assembly of claim 28 wherein the charge is compressed directly against said interior surfaces and the liner and base are formed separate from each other.

30. The shaped charge assembly of claim 29 wherein the base is of a material selected from the group comprising milled steel, stamped metal, and cast metal.

31. The shaped charge assembly of claim 30 wherein the base further comprises upstanding third and fourth walls at opposite ends of the base to each other and extending between first ends of the first and second walls and second ends of the first and second walls, respectively, such that said cavity is defined between the first, second, third and fourth walls, and the liner is secured and extends between the first, second, third and fourth walls so as to seal the charge within the cavity.

32. The shaped charge assembly of claim 30, further comprising first and second means for sealing the charge within the cavity, extending between first ends of the first and second walls, and second ends of the first and second walls, respectively.

33. The shaped charge assembly of claim 32, wherein each said sealing means is a piece of foil.

34. The shaped charge assembly of claim 31, wherein the liner is "V"-shaped and is inwardly concave with respect to a top end of the base.

35. The shaped charge assembly of claim 32, wherein the liner is "V"-shaped and is inwardly concave with respect to a top end of the base.

36. The shaped charge assembly of claim 33, wherein the liner is "V"-shaped and is inwardly concave with respect to a top end of the base.

37. The shaped charge assembly of claim 31, wherein the liner is "W"-shaped and is generally inwardly directed with respect to a top end of the base.

38. The shaped charge assembly of claim 32, wherein the liner is "W"-shaped and is generally inwardly directed with respect to a top end of the base.

39. The shaped charge assembly of claim 33, wherein the liner is "W"-shaped and is generally inwardly directed with respect to a top end of the base.

* * * * *